US009186573B2

(12) United States Patent
Perkins

(10) Patent No.: US 9,186,573 B2
(45) Date of Patent: Nov. 17, 2015

(54) HANDHELD MULTI-STAGE PUZZLE-SOLVING GAME DEVICE

(71) Applicant: Gregory Perkins, Garner, NC (US)

(72) Inventor: Gregory Perkins, Garner, NC (US)

( * ) Notice: Subject to any disclaimer, the term of this patent is extended or adjusted under 35 U.S.C. 154(b) by 123 days.

(21) Appl. No.: 14/192,274

(22) Filed: Feb. 27, 2014

(65) Prior Publication Data

US 2015/0238852 A1 Aug. 27, 2015

(51) Int. Cl.
*A63F 9/08* (2006.01)
*A63F 9/06* (2006.01)

(52) U.S. Cl.
CPC .... *A63F 9/08* (2013.01); *A63F 9/06* (2013.01)

(58) Field of Classification Search
CPC ..... A63F 9/06; A63F 9/08; A63F 9/34; A63F 2250/24
See application file for complete search history.

(56) References Cited

U.S. PATENT DOCUMENTS 4,949,969 A * 8/1990 Johnson ..... A63F 9/001 273/153 R
6,142,784 A * 11/2000 Wood ..... G09B 5/065 434/188
6,581,937 B1 6/2003 Crisswell
8,052,149 B2 11/2011 Sweeting
8,398,080 B2 * 3/2013 Stolten ..... A63F 9/0811 273/153 R
8,398,082 B2 3/2013 Cabrera
2009/0209313 A1 8/2009 Chan et al.
2009/0273140 A1 * 11/2009 Best ..... A63F 9/0826 273/153 S
2009/0309302 A1 12/2009 Langin-Hooper
2010/0207325 A1 8/2010 Gardner
2013/0134675 A1 * 5/2013 Zagyvai ..... A63F 9/0078 273/153 S
2013/0140771 A1 6/2013 Bullock et al.
2013/0323697 A1 12/2013 Shadduck

* cited by examiner

*Primary Examiner* — Steven Wong
(74) *Attorney, Agent, or Firm* — Andrew Alia

(57) ABSTRACT

Disclosed is a multiple-stage puzzle-solving game device comprising a plurality of puzzles imprinted thereon, a plurality of dials, each of which comprising a plurality of indicia imprinted thereon, each indicium representing a probable segment of a solution to a puzzle, and an unsealable sealed reward container comprising a game reward disposed therewithin, and a plurality of dial receptacles disposed on the exterior thereof, each dial receptacle adapted to receive a dial that is pre-assigned thereto. In order to win the game reward, the dials must be rotated to indicate the correct sequential combination of solutions to all puzzles, one puzzle at a time, at which point, reward container is unsealed thereby providing access to the game reward.

38 Claims, 10 Drawing Sheets

HANDHELD MULTI-STAGE PUZZLE-SOLVING GAME DEVICE

BACKGROUND

The present invention relates to game devices and more particularly to game devices that involve puzzle solving, the fulfillment of which leads to winning a game reward.

Today, computer games may have taken over the gaming landscape on account of their ubiquity, but physical game devices, although arguably may have been pushed into the background, have not lost their charm yet. Computer games are armed with the variety in offering their players stunning visuals rendered by advanced graphics, great sound effects, etc., but they do not possess that one quality that cannot be computer-made—tangibility. Physical game devices, especially the ones that involve puzzle-solving, such as, for example, a Rubik's Cube, offer not only the same intrigue and thrill as the computer games, but also make the game-playing experience more realistic and enjoyable as it is basically tangible. Therefore, contrary to popular belief, physical puzzle games are very much welcome in today's market as they not only provide great entertainment to players but also in the process of doing so, aid them in their mental, social, educational, and competitive development.

SUMMARY

The present invention is a handheld multi-stage game device that is embodied by a sealed reward container comprising a game reward disposed there within. The game device involves solving two sets of puzzles in stages, namely, first and second stages, so as to win the game reward. The reward receptacle comprises a plurality dial receptacles wherein, each dial receptacle is adapted to receive a dial there within that is exclusively pre-assigned. Therefore, first-stage puzzles involve a player figuring out which dial to insert into a dial receptacle. The reward receptacle is imprinted with a plurality of second-stage mathematical puzzles, the probable segments of solutions to which are imprinted on the dials in a circular layout. A player upon figuring out the solution to a second-stage puzzle, has to "dial-in" the solution by rotating the dials to indicate a probable segment as the correct segment. If found correctly, an indicator means is activated upon which, the player may move on to solving the next second-stage puzzle. If all the second-stage puzzles are solved, the reward container is unsealed providing access to the game reward within Other objects and advantages of the embodiments herein will become readily apparent from the following detailed description taken in conjunction with the accompanying drawings.

FIGURES

Reference Numerals

10—Game Device
12—Sealed Reward Container
13—Bottom Receptacle
14—Sealer
16—Dial Receptacle
18—Dial
20—Dial Plate
22—Dial Stud
24—Primary Magnet
26—Secondary Magnet
30—Sealer Rod
32—Threaded Portion
34—Threaded Sleeve
36—Sleeve Holder
38—Guide
40—Sealer Pulley
42—Pulley Chain
44—Sealer Motor
46—Support Pulley
48—Indicator Rod
50—Indicator Motor
52—Reward view window.

DETAILED DESCRIPTION

In the following detailed description, a reference is made to the accompanying drawings that form a part hereof, and in which the specific embodiments that may be practiced is shown by way of illustration. These embodiments are described in sufficient detail to enable those skilled in the art to practice the embodiments and it is to be understood that the logical, mechanical and other changes may be made without departing from the scope of the embodiments. The following detailed description is therefore not to be taken in a limiting sense.

Figure 1:
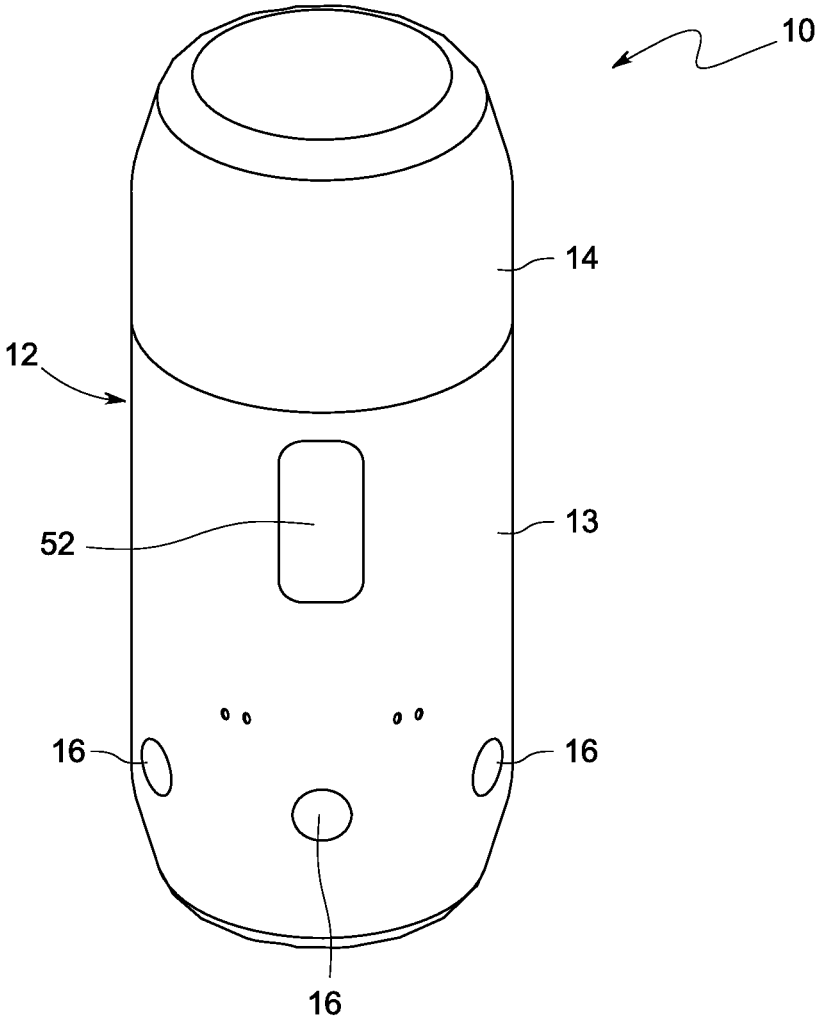
FIG. 1, according to an embodiment of the present invention, is an illustration of a perspective view of the game device without the dials being inserted.

The present invention comprises a handheld multiple-stage puzzle-solving game device, which entails a player to solve a plurality of puzzles in two stages, namely, the first and second stages. The set of puzzles that are to be solved initially (at the first stage) are referred to as "first-stage puzzles," whereas the set of puzzles that are to be solved upon the completion of the first-stage puzzles (at the second-stage) are referred to as "second-stage puzzles" wherein, the first and second-stage puzzles, as will be apparent from the following body of text, differ in nature with respect to one another, or in other words, are not of the same kind or type. Referring to FIG. 1, the game device 10 is basically a sealed reward container 12, within which, a game reward (not shown) is housed whereby, solving (or completing) the plurality of puzzles enables the player to unseal the reward container 12 and thereby access the game reward.

Referring to FIG. 1, the sealed reward container 12 is preferably a vertical, cylindrical structure, preferably with the top and bottom circular edges thereof being rounded-off. The reward container 12 comprises a cylindrical, open top bottom receptacle 13 that actually houses the game reward and a sealer 14 for sealing the top of the bottom receptacle 13. The sealer 14 comprises a circular member with a cylindrical projection member extending perpendicularly from the circular edge thereof. The sealer 14 comprises at least one and preferably three vertical threaded sleeves (not shown), each of which preferably made of brass. Each threaded sleeve is supported by a sleeve holder. The bottom receptacle 13 and the sealer 14 are preferably made of stainless steel.

Referring to FIG. 1, the game device 10 further comprises a plurality of second-stage puzzles (not shown) imprinted on the exterior surface of the reward container 12. More particularly, a second-stage puzzle comprises a mathematical puzzle, the solution to which preferably comprises mathematical constants, such as, $\pi$ (3.14), e (2.17), etc., wherein, each mathematical constant spans to six digits, the necessity for which will be apparent from the following body of text. For example, if the solution to a second-stage puzzle is the mathematical constant $\pi$, then numerical value thereof will be expressed as 3.14159. Preferably, the plurality of second-stage puzzles comprise twelve puzzles, the solution of each being different from one another. In one embodiment, the second-stage puzzles are removable as imprinted engraved on the reward container 12. In one embodiment, the second-stage puzzles are imprinted on around the cylindrical surface of the bottom receptacle 13.

Referring to FIG. 1, the bottom receptacle 13 comprises a plurality of radial-spaced dial receptacles 16 on and around the exterior surface thereof, all disposed at same level from the bottom thereof. Preferably, the dial receptacles 16, as seen in the referred drawing, are disposed on the lower portion of the bottom receptacle 13. A dial receptacle 16 basically comprises a circular opening, the central axis of which is horizontally oriented. More particularly, the plurality of dial receptacles 16 comprise six dial receptacles that are equidistantly spaced apart from one another.

Figure 2:
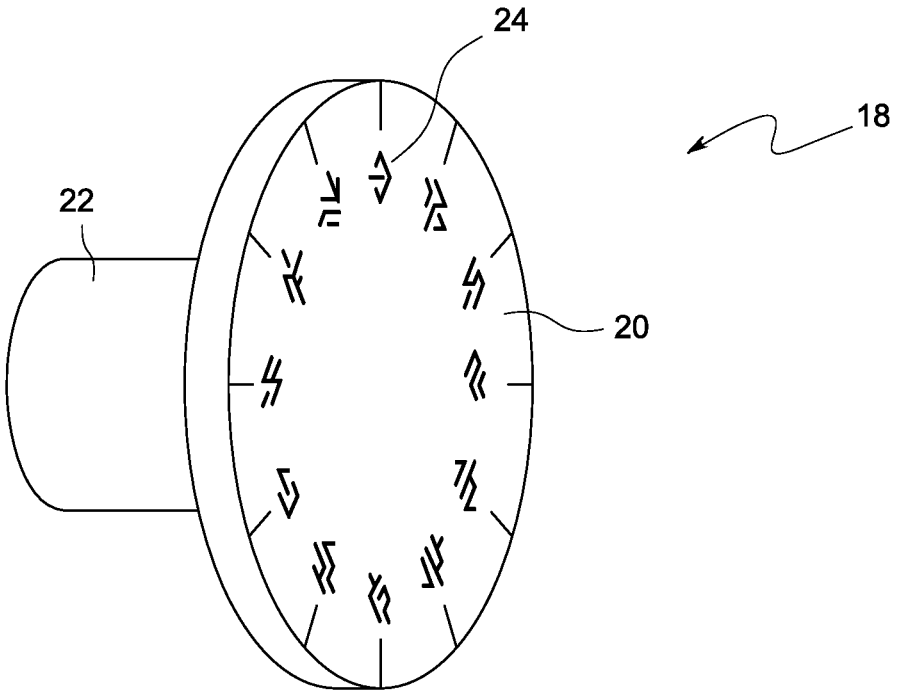
FIG. 2, according to an embodiment of the present invention, is an illustration of a perspective view of the dial.
Figure 3:
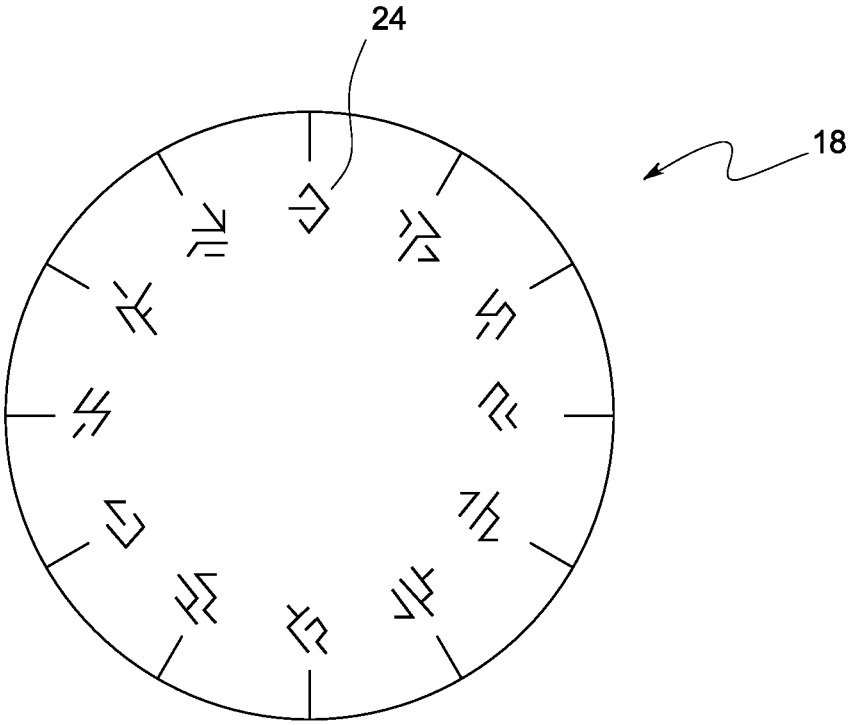
FIG. 3, according to an embodiment of the present invention, is an illustration of a front view of the dial.
Figure 4:
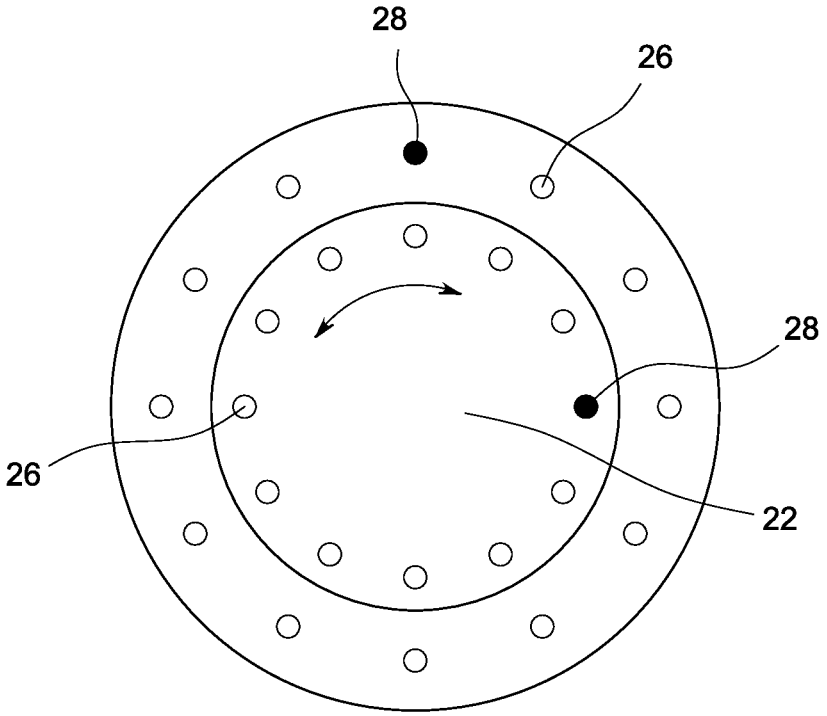
FIG. 4, according to an embodiment of the present invention, is an illustration depicting the arrangement of the two sets of magnets.
Figure 5:
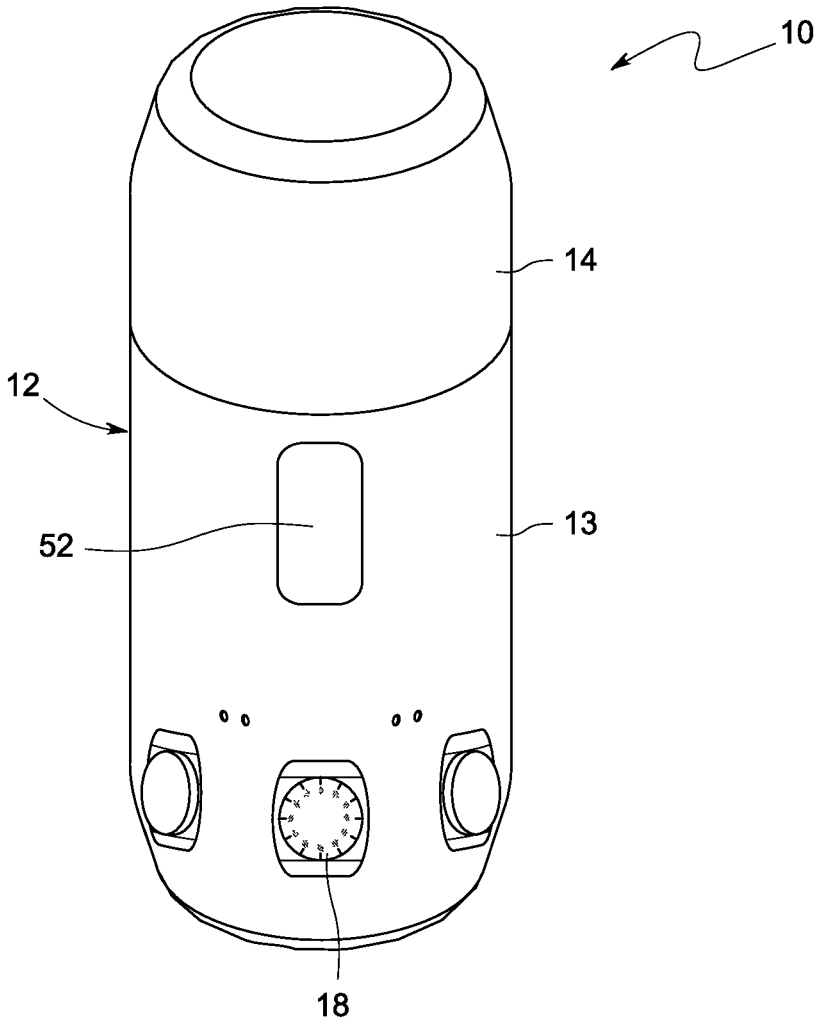
FIG. 5, according to an embodiment of the present invention, is an illustration of a perspective view of the game device with the dials being inserted.
Figure 6:
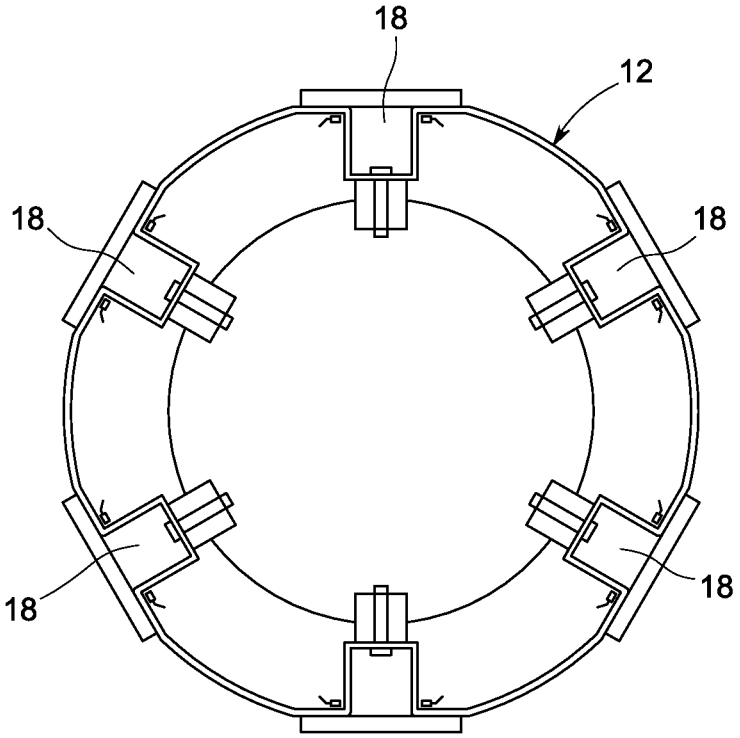
FIG. 6, according to an embodiment of the present invention, is an illustration of a top sectional view of the game device showing the dials inserted within the respective dial receptacles.
Figure 7:
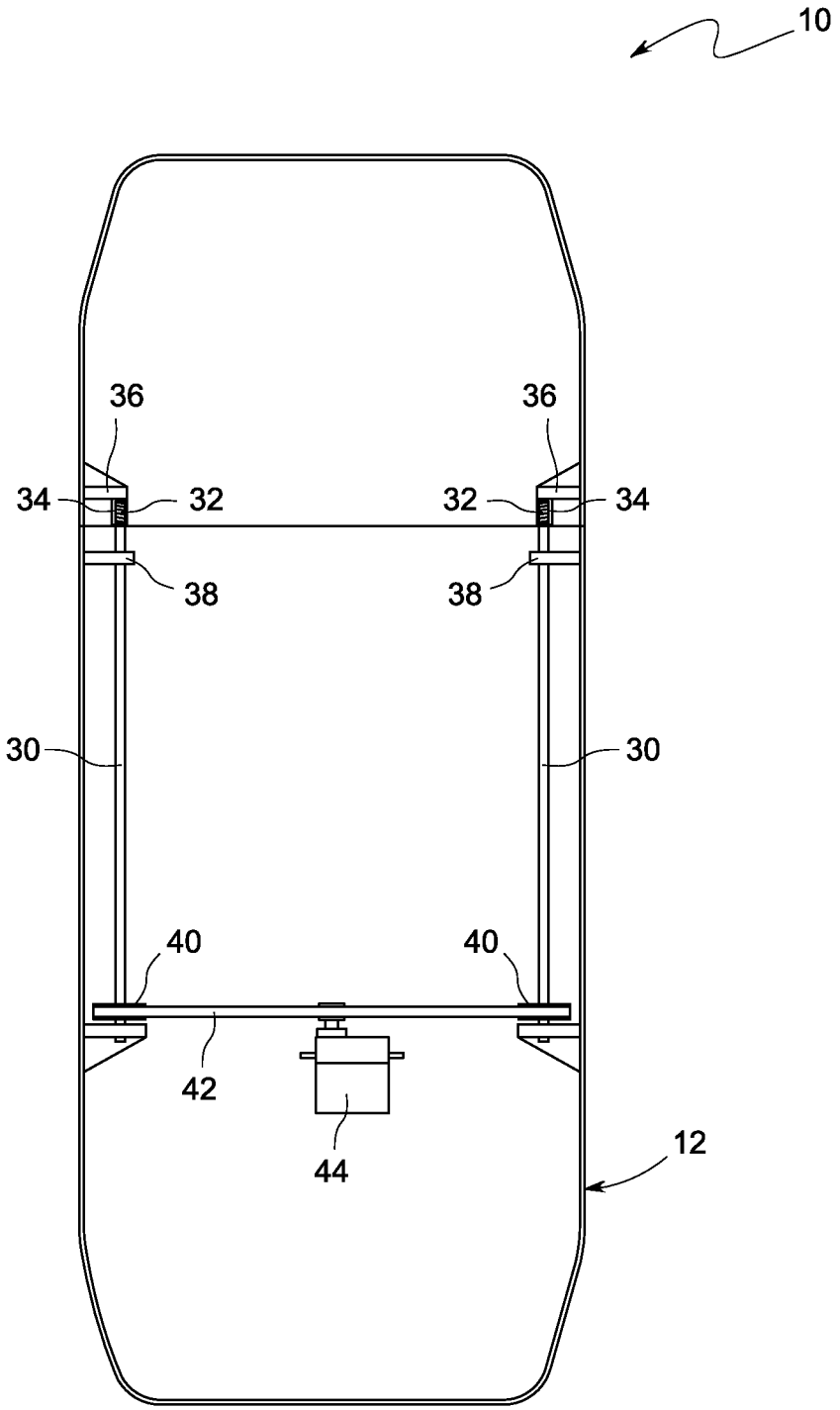
FIG. 7, according to an embodiment of the present invention, is an illustration of the game device depicting components involved in sealing and unsealing the sealer.
Figure 8:
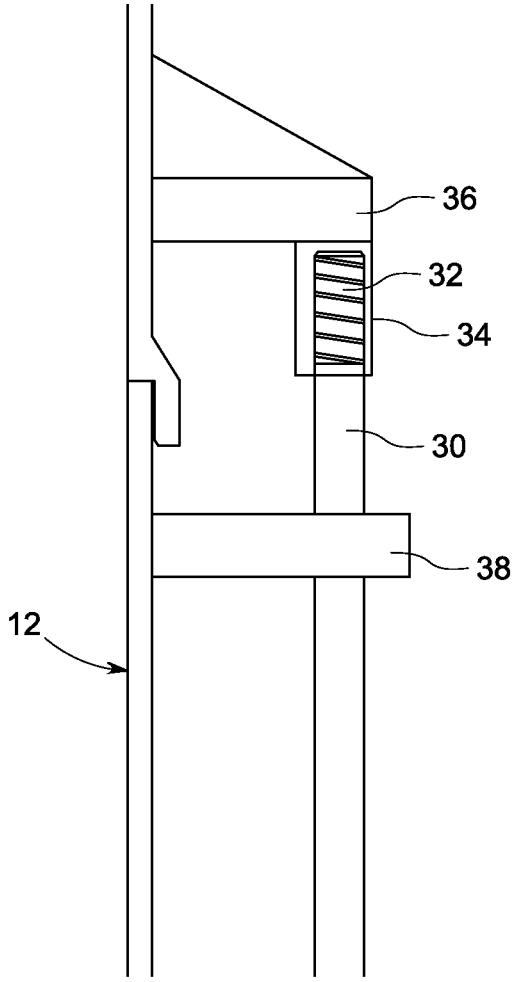
FIG. 8 is a closer view of FIG. 7 depicting the top portion of the sealer rod and the associations thereof.
Figure 9:
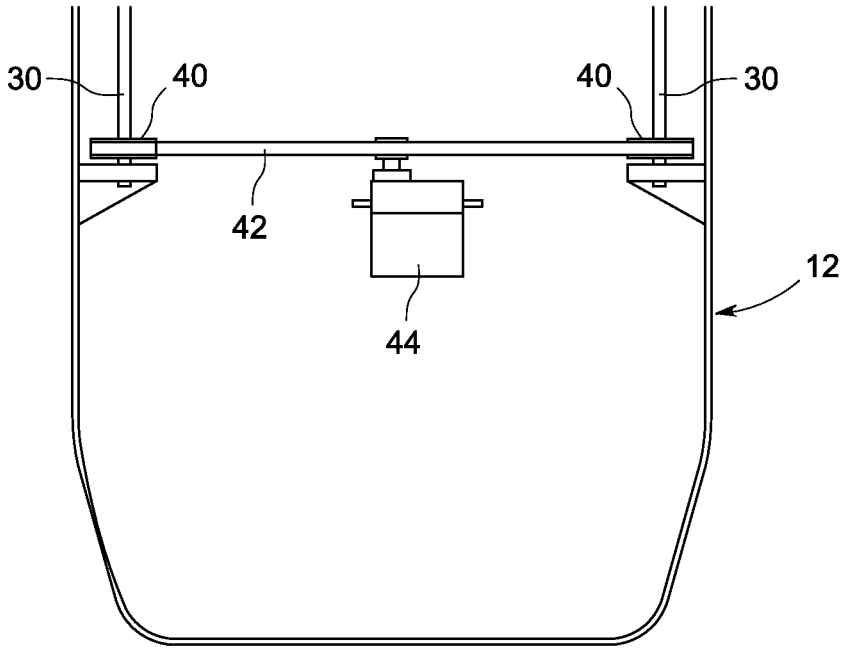
FIG. 9 is a closer view of FIG. 7 depicting the bottom portion of the reward receptacle.
Figure 10:
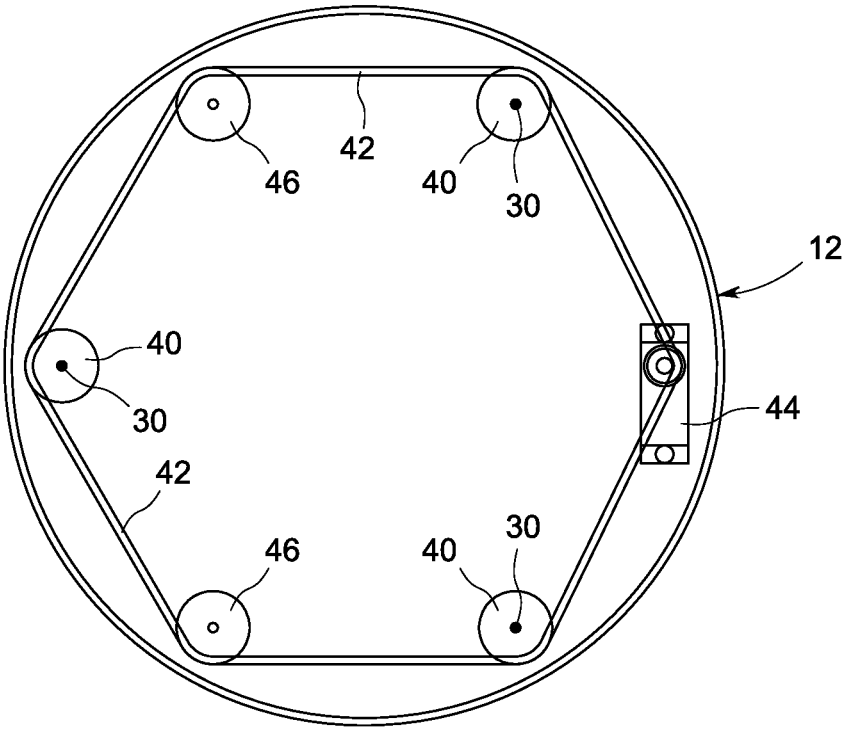
FIG. 10, according to an embodiment of the present invention, is an illustration of the top view of the reward receptacle depicting the sealer rods and the associations thereof.

Referring to FIGS. 1 through 3, the game device 10 further comprises a plurality of dials 18, each of which is adapted to be received within a dial receptacle 16. More particularly, each dial 18, which is preferably made of brass, comprises a circular dial plate 20, which is coaxially joined at the rear thereof by a cylindrical dial stud 22, which actually is adapted to be snugly and rotatable received within the dial receptacle 16 as the dial 18 is received within the dial receptacle 16. The diameter of the dial plate 20 is greater than that of the dial stud 22 and therefore, the dial plate 20, as seen in FIGS. 5 and 6, is projected out of the dial receptacle 16 as the dial stud 22 is received within the dial receptacle 16. Each dial 18 is pre-assigned to a dial receptacle 16 whereby, a dial receptacle 16 only accepts the dial 18 that corresponds thereto. More particularly, each dial 18 is magnetically encoded such that, only the dial receptacle 16 that is sensitive to the code receives the dial 18. Therefore, if a wrong dial 18 is inserted with a dial receptacle 16, the dial receptacle 16 is configured to eject the same. On the other hand, receiving the right dial 18 within a dial receptacle 16 causes the dial 18 to be held within the dial receptacle 16 magnetically. Notably, the aspect of a player identifying which dial 18 to be inserted into a dial receptacle 16 constitutes a first-stage puzzle. As there are six dials 18 to be inserted into six dial receptacles 16, the number of first-stage puzzles to be completed obviously comprises six.

Referring to FIGS. 1 through 3, each dial 18 further comprises a plurality of indicia 24 imprinted thereon in a circular layout wherein, each indicium 24 represents a probable segment (or part) of a solution to a second-stage puzzle wherein, the probable segment (of a solution) represents one of the six digits of a mathematical constant, which, as mentioned earlier, is the solution to the second-stage puzzle. As each indicium 24 represents a probable segment (or digit), only one indicium 24 represents the correct (or actual) segment (or digit), the question of which is to be determined by the player. As it can be easily inferred that the solution to each second-stage puzzle has to be sequentially inputted by way of rotating the six dials 18 to indicate the six digit solution. For example, if the solution to a second-stage puzzle comprises 3.14159, then first dial 18 should be rotated to an indicium that represents 3, the second dial 18 should be rotated to an indicium 24 that represents 1, and so on and so forth so that, ultimately, the sequential combination of the segments read 3.14159. Notably, a Chevron mark is located between the first and second dial receptacles 16 as a representation of a decimal point.

Referring to FIGS. 1 through 4, a set of tiny magnets each is located on the backside of the dial receptacle 16 and the dial 18 arranged in a circular formation wherein, the combination of the sets of tiny magnets acts as a sensor for registering a input performed by the player by rotating the dial 18 to indicate a probable segment for a second-stage puzzle. In each set of magnets, one magnet comprises a primary magnet 28, while the rest comprise secondary magnets 26, wherein, a correct segment is the one that coincides the primary magnets 28 of the dial and the dial receptacle.

Referring to FIGS. 7 through 10, the game device 10 further comprises at least one and preferably three vertical sealer rods 30 that extend upwardly from within the bottom receptacle 13. The three sealer rods 30 are spaced apart from one another such that, the three sealer rods 30 resemble the vertices of an equilateral triangle as viewed from top. The top end of the sealer rod 30 terminates in a threaded portion 32. Each threaded portion 32 is adapted to be threadably received within a threaded sleeve 34 supported by the corresponding sleeve holder 36 so as to seal the sealer 14 to the bottom receptacle 13. The top portion of each sealer rod 30 is supported by a guide 38 comprising a guide sleeve (not labeled) that enables the top portion of the sealer rod 30 to slide through. The bottom end of each sealer rod 30 is coaxially secured to a sealer pulley 40 driven by a pulley chain 42, which in turn is driven by a sealer motor 44. The game device 10 further comprises two support pulleys 46 driven by the pulley chain 42 wherein, the two support pulleys 46 are placed between the three sealer pulleys 40 so as to alleviate the stress on the sealer pulleys 40 imparted by the pulley chain 42 by easing the rotational movement of the pulley chain 42. As viewed from top, the pulley chain 42 engaging the sealer pulleys 40, the support pulleys 46, and the sealer motor 44 is hexagonally shaped with the sealer pulleys 40, the support pulleys 46, and the sealer motor 44 being at the vertices thereof. The sealer motor 44 comprises a servomotor adapted to receive signals for the actuation thereof. More particularly, the game device 10 is configured transmit an actuation signal to the sealer motor 44 (resulting in the sealer 14 being unsealed by the unscrewing of the sealer rods 30) upon the player completing the second-stage puzzles in the right sequence.

Figure 11:
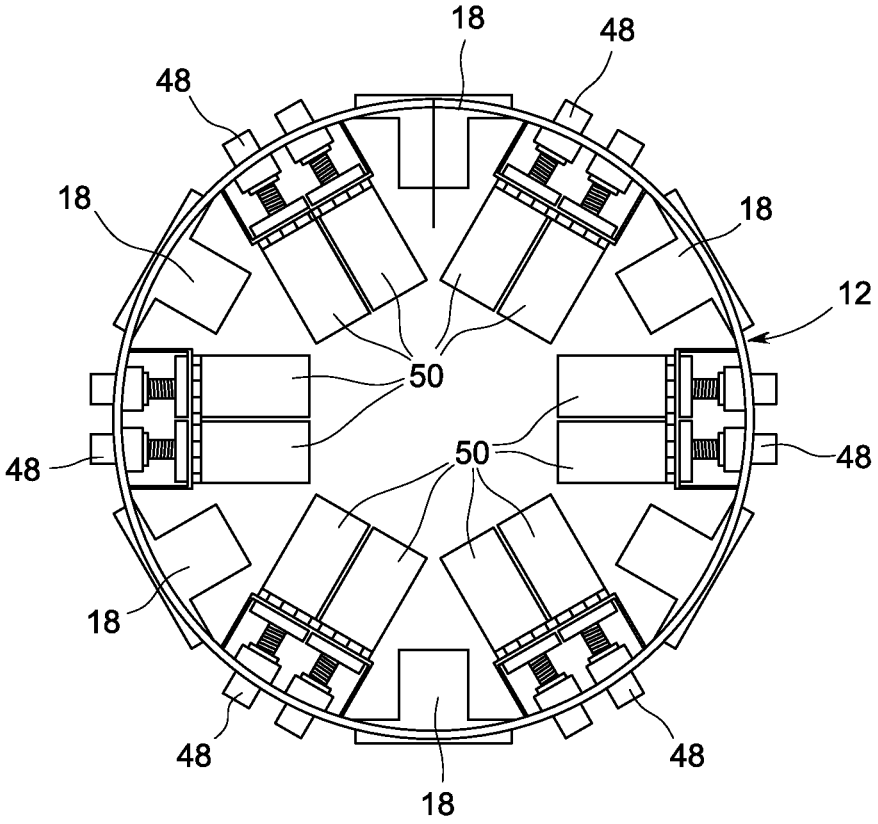
FIG. 11, according to an embodiment of the present invention, is an illustration of the top view of the reward receptacle depicting the indicator rods and the associations thereof.

Referring to FIGS. 1 and 11, the game device 10 further comprises a plurality of horizontal indicator rods 48, more particularly, twelve indicator rods 48, radially arranged within the bottom receptacle 13 wherein, each indicator rod 48 is pre-associated with a second-stage puzzle dial receptacle 16. An indicator rod 48 is extendable beyond the exterior surface of the bottom receptacle 13 via an indicator hole. Each indicator rod 48 is actuated by an indicator motor 50 so as to move the indicator rod 48 from a default indented position to a flat position, and from the flat position to a extended position wherein, in the indented position, the tip of the distal portion of the indicator rod 48 is furthest from the exterior surface of the bottom receptacle 13 and towards the corresponding indicator motor 50, wherein, in the flat position, the tip of the distal portion of the indicator rod 48 is flush with the exterior surface of the bottom receptacle 13, and wherein, in the extended position, the tip of the distal portion of the indicator rod 48 extends beyond the exterior surface of the bottom receptacle 13. Each indicator motor 50 is disposed within the reward receptacle 13 and is threadable and coupled to an indicator rod 48 at the proximal end thereof such that, rotary motion from the indicator motor 50 (caused by the actuation thereof) is converted into reciprocatory motion of the indicator rod 48. Each indicator motor 50, more particularly, comprises a servomotor adapted to receive actuation signals for the actuation thereof.

Referring to FIG. 11, the tip of the distal portion of each indicator rod 48 resembles a button (referred to as "indicator button" hereinafter) so as to give the impression of a button being depressed as the indicator rod 48 moves from the extended position to the flat position, and from the flat position to the indented position. The game device is configured such that, the indicator buttons, by virtue of the indicator motors 50 thereof, are moved from the indented to flat position upon a player completing the corresponding first-stage puzzle so as to indicate to user that he/she has successfully completed the corresponding first-stage puzzle. The game device is further configured such that, the indicator buttons are moved from the flat to extended position upon a player completing the corresponding second-stage puzzles so as to indicate to user that he/she has successfully completed the corresponding second-stage puzzles. In one embodiment, the game device configured such that, the sealer motor is actuated upon all the indicator rods 48 are moved from flat to extended position.

Once the reward container is released and the game reward is accessed, placing the sealer atop the unsealed bottom receptacle after a predetermined amount of a time, for example 36 minutes, will result in sealer being re-sealed and the dials being ejected indicating that the game device has been reset for another session of play. However, if the sealer is placed before the predetermined amount of time, only one sealer rod engages the threaded sleeve, wherein, the sealer rod pertains to the indicator rod or rods that corresponds to the $12^{th}$ second-stage puzzle. This is a temporary state as the player may reopen the reward container by re-solving the $12^{th}$ second-stage puzzle. However, if the $12^{th}$ second-stage puzzle has not been resolved, after the predetermined time, as mentioned earlier, the sealer is completely sealed to the bottom receptacle and the dials are ejected indicating an overall reset. Alternatively, a predetermined deterrent sequence of indicia is provided, which when inputted by the player, the game device is configured to not seal the sealer over the bottom receptacle. Further, a predetermined locking sequence of indicia is provided, which when inputted by a player, the sealer is immediately sealed to the bottom receptacle. For maintenance purposes, another specific maintenance sequence is provided, which when inputted into a sealed reward container, the reward container is immediately unsealed.

Referring to FIG. 1, the game device 10 is preferably powered by a battery, which preferably is rechargeable. The game device 10 may also be powered directly from a conventional domestic electrical socket by an inductive charging system consisting of two parts (1. Inductive charging coil imbedded in epoxy on the bottom of the capsule, 2. Inductive charging pad that will be connected to a wall outlet, 120 or 220 VAC.) The game device 10 further comprises a reward view window 52 for displaying the game reward. The battery status will be indicated by an audio alert. When battery charge level reaches 25% then the indicator will alert once every 0.60 seconds. When battery charge level reaches 15% then the indicator will alert once every 36 seconds. When battery charge level reaches 10% then the indicator will alert once every 12 seconds.

In one embodiment, the window 52 is adapted to display countdown timers and other symbols that have nothing to do with the puzzles but to distract the player. This has been eliminated.

The foregoing description of the specific embodiments will reveal the general nature of the embodiments herein that others can, by applying current knowledge, readily modify and/or adapt for various applications such specific embodiments without departing from the general concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the appended claims.

Although the embodiments herein are described with various specific embodiments, it will be obvious for a person skilled in the art to practice the invention with modifications. However, all such modifications are deemed to be within the scope of the claims.

What is claimed is:

1. A multiple-stage puzzle-solving game device comprising:

(a) a plurality of second-stage puzzles;

(b) a plurality of dials, each of which comprising a plurality of indicia imprinted thereon, each indicium representing a probable segment of a solution to a second-stage puzzle, the probable segment being either correct or incorrect, for a second-stage puzzle, the indication of a sequential combination of a plurality of correct segments by virtue of the rotation of the plurality of dials make up the solution therefor; and (c) an unsealable sealed reward container comprising:

(i) a game reward disposed therewithin;

(ii) a plurality of dial receptacles disposed on the exterior thereof, each dial receptacle adapted to exclusively rotably receive a dial that is pre-assigned thereto therewithin wherein, the aspect of identifying a dial for insertion into the dial receptacle that is pre-assigned thereto constituting a first-stage puzzle, (iii) a plurality of radially spaced apart indicator holes; and (iv) a plurality of indicator rods disposed therewithin such that, a distal portion of an indicator rod, via an indicator hole, is radially extendable beyond the exterior of the reward container, while a proximal end of the indicator rod is located therewithin, each indicator rod is radially movable from a default indented position to a flat position and from the flat position to a extended position wherein, in the indented position, the tip of the distal portion of the indicator rod is furthest from the exterior surface of the reward container and towards the corresponding indicator motor, wherein, in the flat position, the tip of the distal portion of the indicator rod is flush with the exterior surface of the reward container, and wherein, in the extended position, the tip of the distal portion of the indicator rod extends beyond the exterior surface of the reward container, every two indicator rods configured to correspond with a first-stage puzzle such that, that solving of a first-stage puzzle results in corresponding pair of indicator rods to be moved from the indented position to the flat position, each indicator rod configured to correspond with a second stage puzzle such that, the solving of a second-stage puzzle results in the corresponding indicator rod to be moved from the indented position to the flat position;

wherein, the movement of all the indicator rods from the flat position to the extended position resulting in the reward container becoming unsealed rendering the game reward accessible.

2. The game device of claim 1 configured such that, a second-stage puzzle can be attempted only upon the completion of the first-stage puzzles.

3. The game device of claim 1 comprising a handheld device.

4. The game device of claim 1 wherein, the reward container comprising:

(a) a sealer comprising at least one vertical threaded sleeve disposed thereon;

(b) an open top bottom receptacle that houses the game reward, the open top of the bottom receptacle sealed by the sealer, the bottom receptacle comprising:

(i) at least one vertical sealer rod extending upwardly therefrom, the top end portion of each sealer rod terminating in a threaded portion, which is adapted to be received within a threaded sleeve thereby sealing the bottom receptacle with the sealer; and (ii) at least one sealer motor for powering the axial rotation of each and at least one sealer rod resulting in the threaded portion of each sealer rod being screwed into the corresponding threaded sleeve and unscrewed from the corresponding threaded sleeve;

wherein, the game device is configured such that, the at least one sealer motor is actuated upon the movement of the plurality completion of the second-stage puzzles.

5. The game device of claim 4 wherein, the at least one sealer rod extends from within the bottom receptacle.

6. The game device of claim 4 wherein, the at least one threaded sleeve and the at least one sealer rod comprises a plurality of threaded sleeves and a plurality of sealer rods respectively.

7. The game device of claim 6 wherein, the plurality of threaded sleeves and the plurality of sealer rods comprise three threaded holes and three sealer rods respectively, the three threaded holes and the three sealer rods being equidistant from one another such that, the three threaded holes and the three sealer rods resemble the vertices of an equilateral triangle when viewed from top.

8. The game device of claim 4 wherein, the bottom end portion of each sealer rod is coaxially secured to a sealer pulley, each sealer pulley driven by a pulley chain, which, in turn, is driven by the at least one sealer motor.

9. The game device of claim 8 further comprises a plurality of support pulleys driven by the pulley chain, the plurality of support pulleys disposed between the plurality of sealer pulleys.

10. The game device of claim 9 wherein, the shape of the pulley chain, as viewed from top, resembles a regular polygon with each of the plurality of support pulleys, the plurality of sealer pulleys, and the at least one sealer motor being at a vertices thereof.

11. The game device of claim 10 wherein, the regular polygon comprises a regular hexagon.

12. The game device of claim 9 wherein, the plurality of support pulleys comprise two support pulleys.

13. The game device of claim 4 wherein, each sealer motor comprises a servomotor configured to receive an actuation signal upon the movement of the indicator rods from the flat position to the extended position.

14. The game device of claim 4 wherein, the at least one sealer motor comprises one sealer motor.

15. The game device of claim 4 wherein, the top portion of the at least one sealer rod is supported by a guide comprising a guide sleeve that enables the top portion of the corresponding sealer rod to pass therethrough.

16. The game device of claim 4 wherein, the plurality of indicator holes and the plurality of indicator rods are disposed within the bottom receptacle.

17. The game device of claim 16 wherein, the bottom receptacle further comprises a plurality of indicator motors disposed therewithin, each indicator motor for receiving the proximal portion of an indicator rod therewithin wherein, as an indicator motor is actuated, the indicator rod is radially movable from the indented position to the flat position and from the flat position to the extended position, the game device configured such that, upon the completion of a first-stage puzzle, a corresponding at least one indicator motor is actuated so as to move the corresponding at least one indicator rod from the indented position to the flat position and wherein, upon the completion of a second-stage puzzle, a corresponding indicator motor is actuated so as to move the corresponding indicator rod from the flat position to the extended position.

18. The game device of claim 17 wherein, an indicator motor comprises a servomotor.

19. The game device of claim 17 wherein, the plurality of indicator motors comprises twelve indicator motors.

20. The game device of claim 17 wherein, the proximal end of each indicator rod is threadably received within the corresponding indicator motor.

21. The game device of claim 1 wherein, each indicator rod is horizontally disposed.

22. The game device of claim 1 wherein, the tip of the distal portion of each indicator rod is configured to resemble a button.

23. The game device of claim 1 wherein, the second-stage puzzles are removably imprinted engraved on the sealed receptacle.

24. The game device of claim 1 wherein, the plurality of indicia is removably imprinted engraved on each dial.

25. The game device of claim 1 wherein, each dial is uniquely magnetically encoded.

26. The game device of claim 25 wherein, the magnetic encoding comprises the arrangement of a plurality of tiny magnets on the rear portion of a dial that is to be received within a dial receptacle in a configuration.

27. The game device of claim 1 wherein, each dial receptacle, upon receiving a dial therewithin that is not pre-assigned thereto, ejects the dial.

28. The game device of claim 1 wherein, each second-stage puzzle comprises a mathematical puzzle.

29. The game device of claim 28 wherein, the solution to each mathematical puzzle comprises a six-digit mathematical constant, each digit of which is represented by an indicium on a dial, each digit constituting a correct segment.

30. The game device of claim 1 powered by a rechargeable battery.

31. The game device of claim 1 wherein, the plurality of indicia on each dial is imprinted in a circular layout so that the dial can be rotated to a position to indicate the selection of an indicium.

32. The game device of claim 1 wherein, the number of indicia on a dial is equivalent to the number of second stage puzzles.

33. The game device of claim 1 wherein, the plurality of indicia and second-stage puzzles comprises twelve indicia and second-stage puzzles each.

34. The game device of claim 1 wherein, the plurality of dial receptacles comprises six dial receptacles.

35. The game device of claim 1 further comprising a display screen for displaying audio alert indicating the current battery power level.

36. The game device of claim 1 wherein, each dial comprises a cylindrical insert that coaxially extends from the backside thereof, the insert snugly received within the dial receptacle as the dial is received within the dial receptacle.

37. The game device of claim 1 wherein, the second-stage puzzles are represented by hieroglyphs, pictograms, or a combination thereof.

38. A handheld multiple-stage puzzle-solving game device comprising:

(a) a plurality of second-stage puzzles;

(b) a plurality of dials, each of which comprising a plurality of indicia imprinted thereon, each indicium representing a probable segment of a solution to a second-stage puzzle, the probable segment being either correct or incorrect, for a second-stage puzzle, the indication of a sequential combination of a plurality of correct segments by virtue of the rotation of the plurality of dials make up the solution therefor; and (c) an unsealable sealed reward container comprising:

(i) a sealer comprising at least one vertical threaded sleeve disposed thereon;

(ii) an open top bottom receptacle that houses the game reward, the open top of the bottom receptacle sealed by the sealer, the bottom receptacle comprising:

(1) a game reward disposed therewithin;

(2) a plurality of dial receptacles disposed on the exterior thereof, each dial receptacle adapted to exclusively rotably receive a dial that is pre-assigned thereto therewithin wherein, the aspect of identifying a dial for insertion into the dial receptacle that is pre-assigned thereto constituting a first-stage puzzle, (3) a plurality of radially spaced apart indicator holes; and (4) a plurality of indicator rods disposed therewithin such that, a distal portion of an indicator rod, via an indicator hole, is radially extendable beyond the exterior of the reward container, while a proximal end of the indicator rod is located therewithin, each indicator rod is radially movable from a default indented position to a flat position and from the flat position to a extended position wherein, in the indented position, the tip of the distal portion of the indicator rod is furthest from the exterior surface of the reward container and towards the corresponding indicator motor, wherein, in the flat position, the tip of the distal portion of the indicator rod is flush with the exterior surface of the reward container, and wherein, in the extended position, the tip of the distal portion of the indicator rod extends beyond the exterior surface of the reward container, every two indicator rods configured to correspond with a first-stage puzzle such that, that solving of a first-stage puzzle results in corresponding pair of indicator rods to be moved from the indented position to the flat position, each indicator rod configured to correspond with a second stage puzzle such that, the solving of a second-stage puzzle results in the corresponding indicator rod to be moved from the indented position to the flat position;

wherein, the movement of all the indicator rods from the flat position to the extended position resulting in the reward container becoming unsealed rendering the game reward accessible.

* * * * *